US006227742B1

(12) United States Patent
Corn et al.

(10) Patent No.: US 6,227,742 B1
(45) Date of Patent: May 8, 2001

(54) DEVICE FOR USE IN WASHING THE BACK OF A PERSON

(76) Inventors: John F. Corn; Gwendolyn P. Corn, both of 1981 Lakewood Club Dr. South, Unit 4F, St. Petersburg, FL (US) 33712

( * ) Notice: Subject to any disclaimer, the term of this patent is extended or adjusted under 35 U.S.C. 154(b) by 0 days.

(21) Appl. No.: 09/320,492

(22) Filed: May 26, 1999

(51) Int. Cl.[7] ..... A47K 7/02

(52) U.S. Cl. ..... 401/201; 401/6; 401/8; 15/208; 601/138

(58) Field of Search ..... 401/201, 196, 401/6, 88, 8; 15/208, 222; 601/137, 138

(56) References Cited

U.S. PATENT DOCUMENTS

| | | | | |
|---|---|---|---|---|
| D. 363,810 | | 10/1995 | Smith . | |
| 1,404,401 | | 1/1922 | Novick . | |
| 2,035,014 | | 3/1936 | Schaefer . | |
| 2,333,436 | | 11/1943 | Novick . | |
| 2,363,697 | | 11/1944 | Schirmer . | |
| 3,124,827 | | 3/1964 | Hull . | |
| 3,674,374 | * | 7/1972 | Jennings . | |
| 3,812,849 | | 5/1974 | Guinta . | |
| 3,860,349 | | 1/1975 | Scott . | |
| 3,959,841 | | 6/1976 | Horne . | |
| 3,977,796 | * | 8/1976 | Gillespie | 401/201 |
| 4,196,490 | | 4/1980 | Jonzon . | |
| 5,486,064 | * | 1/1996 | Schulte | 401/201 |
| 5,509,164 | | 4/1996 | Weill . | |
| 5,545,456 | | 8/1996 | Suida . | |

* cited by examiner

*Primary Examiner*—David J. Walczak
(74) *Attorney, Agent, or Firm*—Dennis G. LaPointe; Mason & Associates, P.A.

(57) ABSTRACT

A device for use in washing the back of a person having an elongate sheet of flexible material folded such that the edges are secured together to form a sleeve; a pocket is formed intermediate the sleeve for holding a bar of soap. The pocket is formed by securing opposing internal faces of the sleeve along stitch lines forming a perimeter of the pocket. The pocket further has an opening for inserting the bar of soap into the pocket; the opening in the pocket has hook and loop fasteners for releasably securing the bar of soap within the pocket. Handles in the form of endless rings are provided at each end of the sleeve. Each handle is slidingly engaged in a loop formed at each end of the sleeve wherein each end is wrapped around a portion of the handle means and secured onto itself to form a loop.

14 Claims, 3 Drawing Sheets

DEVICE FOR USE IN WASHING THE BACK OF A PERSON

BACKGROUND OF THE INVENTION

1. Field of the Invention

The invention relates to a device for use in washing the back of a person, for ease in the harder to reach areas of the back and to benefit people with a limited range of motion.

2. Description of Related Art

Back washing devices are known in the art. However, the prior devices, although beneficial for many with handicaps and for larger persons who have difficulty washing their backs, have shortcomings or are intended to provide combined washing and massaging effects.

For example, U.S. Pat. No. 5,545,456 to Suida discloses a device for washing and massaging the back of a person. It has a plurality of pockets to accommodate the soap and massaging accessories. It is made from both coarse and smooth wash cloth material. The handles are fixed and are adapted to engage a thumb, thereby adding concentrated stresses to a handicap's person hand in the thumb area. Other known related art includes a sponge assembly with straps attached at each end to D-shaped rings depicted in U.S. Pat. No. 4,196,490 to Jonzon, a body scrubber depicted in U.S. Design Pat. No. Des. 363,810 to Smith, Jr., a combination body and back bath scrubber depicted in U.S. Pat. No. 5,509,164 to Weill, a bathing implement depicted in U.S. Pat. No. 2,035,014 to Schaefer, a bathing accessory for the back depicted in U.S. Pat. No. 3,860,349 to Scott and a back scrubber depicted in U.S. Pat. No. 3,674,374 to Jennings.

None of the devices in the above references solve the problem of providing a simple and easy to use device which can be used by people with medical handicaps related to hand, fingers, shoulders and/or arm problems as well as by large people who have difficulty reaching hard to reach areas of the back. For example, the handles in the present invention slidingly engage a loop formed at the ends of the sleeve forming the wash cloth, whereby as the user moves the wash cloth in any direction, the ring reorients itself by the sliding movement to minimize any stress on a person's hands. In addition, the present invention does not utilize a plurality of sheets with differing coarseness for combined scrubbing or massaging and washing. Instead the present invention provides for a wash cloth made from a single material, preferably a nylon cloth material. Such constructive features allow the device to effectively wash and condition the skin while being gentle enough for daily use by adults and children, especially those with disabilities.

SUMMARY OF THE INVENTION

The present invention is a device for use in washing the back of a person which includes an elongate sheet of flexible material having a first lateral end, a second lateral end, a first longitudinal edge and a second longitudinal edge, the sheet being folded such that the edges are secured together to form a sleeve. Means for holding cleaning means at an intermediate portion of the sleeve is included and forms a pocket by securing opposing internal faces of the sleeve along predetermined stitch lines which form a perimeter of the pocket. The pocket further has an opening for inserting the cleaning means into the pocket and for removing the cleaning means therefrom. The opening in the pocket further has means for releasably securing the cleaning means within the pocket.

Handle means at each of the first and second ends of the sleeve are provided. Each handle means is slidingly engaged in a loop formed at each of the ends of the sleeve wherein each opposing end is wrapped around a portion of the handle means and secured onto itself to form the loop. The handle means comprise an endless-shaped ring for easy grasping by a person's hands.

The cleaning means is preferably a bar of soap; however, a combination of a bar of soap and a sponge body, a combination of liquid soap and a sponge body, a combination of a bar of soap, liquid soap and a sponge body, or a combination of segments of nylon material and a bar of soap or liquid soap, may also be used. The means for releasably securing the cleaning means within the pocket is preferably hook and loop fastener material such as that made by Velcro™; although other means such as buttons and zippers may be used.

The flexible material forming the sleeve or wash cloth is preferably made from nylon cloth material; although other materials such as terry cloth, bath towel, jute cloth or cotton cloth may be used, including synthetic materials, rayons, polyesters and other similar materials. The handle means is an endless-shaped ring made from polymeric material and can be rigid or flexible. The preferred material is flexible vinyl tubing wherein the ends of the tubing are joined and secured to form the ring.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
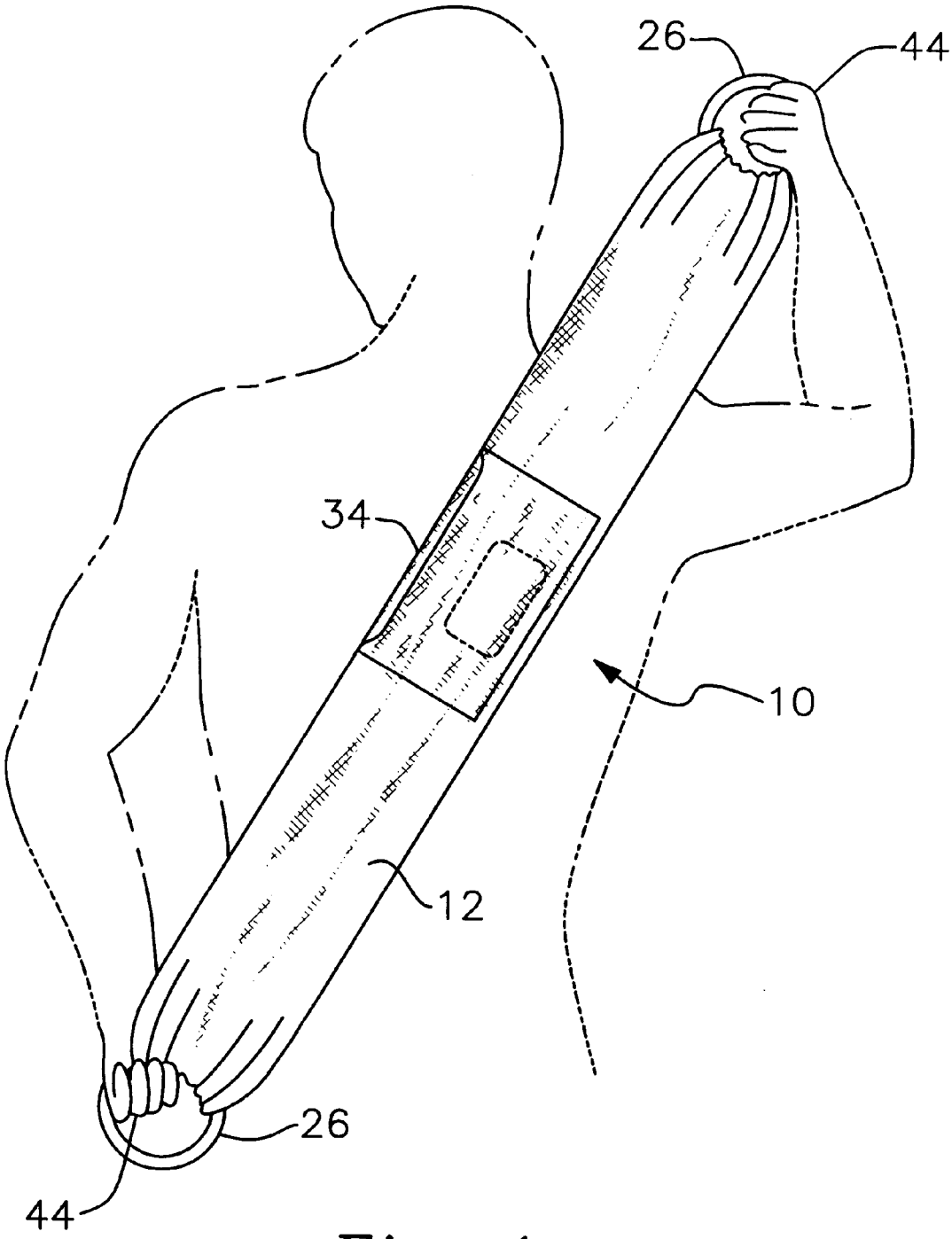
FIG. 1 is a perspective view of the present invention in use.
Figure 2:
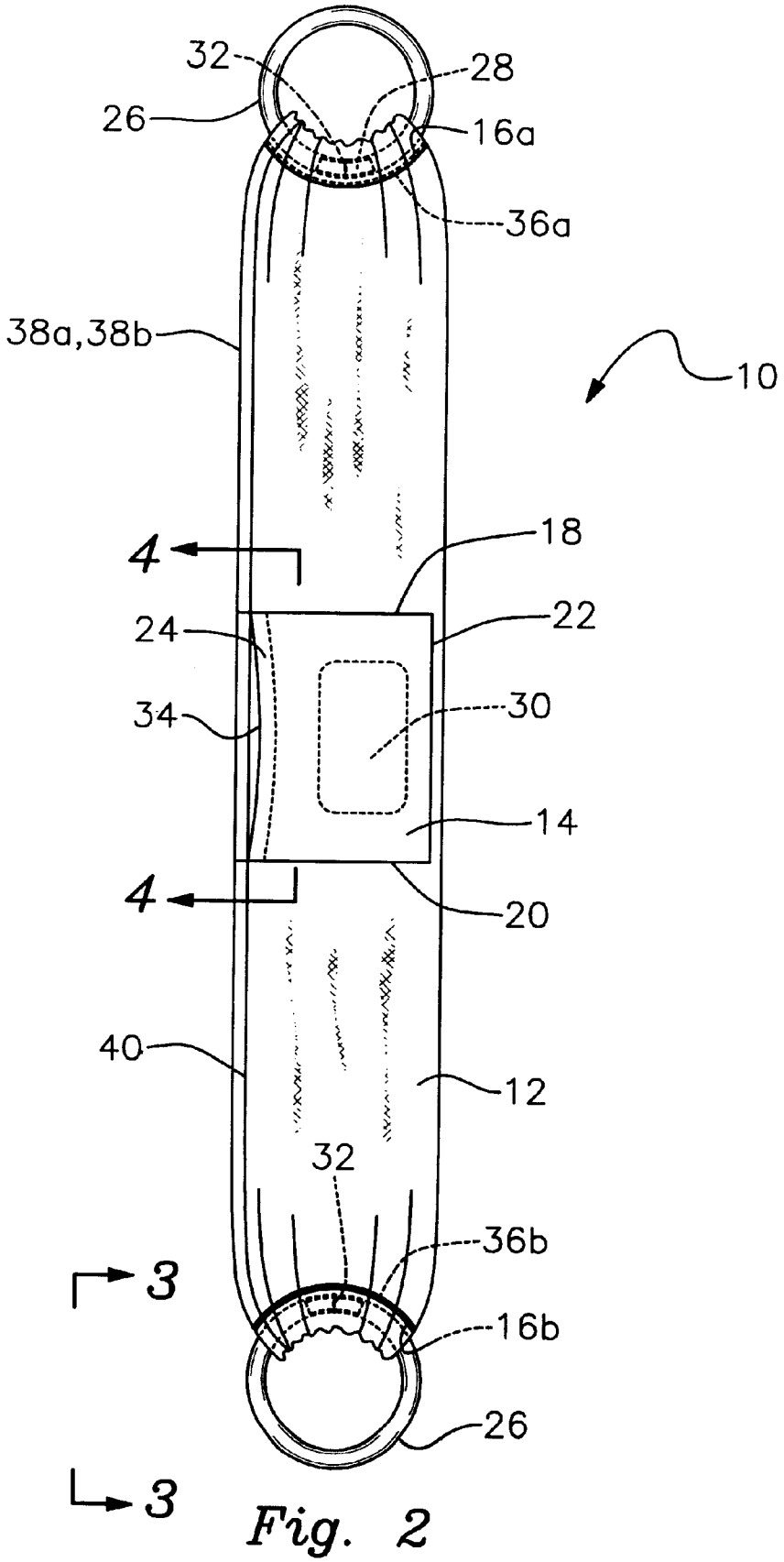
FIG. 2 is a front side view of the present invention.
Figure 4:
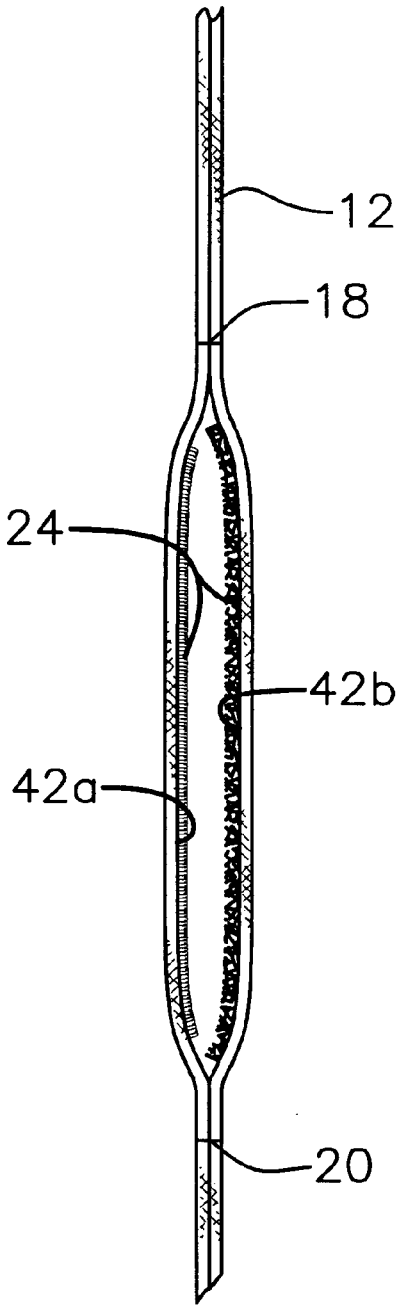
FIG. 4 is a cross-sectional view of the pocket portion of the present invention.

Referring now to the drawings, in particular FIGS. 1 and 2, the invention which is a device for use in washing the back of a person and is depicted generally as 10, comprises an elongate sheet 12 of flexible material having a first lateral end 36*a*, a second lateral end 36*b*, a first longitudinal edge 38*a*, and a second longitudinal edge 38*b*, the sheet 12 being folded such that the edges 38*a*,38*b* are secured together by stitch line 40 to form a sleeve. The device 10 includes means 14 for holding cleaning means 30 at an intermediate portion of the sleeve, the means 14 for holding cleaning means 30 being a pocket formed by securing opposing internal faces 42*a*,42*b* (see FIG. 4) of the sleeve along predetermined stitch lines 18,20,22 forming a perimeter of the pocket. The pocket further has an opening 34 for inserting the cleaning means 30 into the pocket and for removing the cleaning means 30 therefrom. The opening 34 in the pocket further includes means 24 for releasably securing the cleaning means 30 within the pocket.

The present invention further comprises handle means 26 at each end 36*a*,36*b* of the sleeve, each handle means 26 being slidingly engaged with each end 36*a*,36*b* of the elongate sheet 12 of flexible material formed into the sleeve. The handle means are preferably endless-shaped rings for easy grasping by a person's hands 44, as depicted in FIG. 1, where the person is depicted in phantom.

The stitch lines 18,20,22 forming the perimeter of the pocket include at least one longitudinal stitch line 22 parallel to the longitudinal edges 38*a*,38*b* and substantially parallel lateral stitch lines 18,20 spaced apart a predetermined distance so that the formed pocket can receive the cleaning means 30.

The cleaning means 30 is selected from the group consisting of a bar of soap, a combination of a bar of soap and a sponge body, a combination of liquid soap and a sponge body, and a combination of a bar of soap, liquid soap and a sponge body. It is anticipated that in most cases, a practical application will involve the use of a bar of soap, although those who prefer liquid soap may use a sponge body to which the liquid soap is applied.

The means 24 for releasably securing the cleaning means 30 within the pocket is selected from the group consisting of hook and loop fasteners, buttons, and zippers. Because it is more economical and it minimizes the chances of scratching a person's skin, it is preferred that a hook and loop fastener such as that manufactured by Velcro™ be used with the device. Such a fastener can be sewn on the inside surfaces of the opening to the pocket thereby ensuring that only a smooth wash cloth is in contact with the skin.

The elongate sheet 12 of flexible material forming the sleeve is preferably selected from materials such as nylon cloth, terry cloth, bath towel, jute cloth, and cotton cloth. Similar materials such as rayons, polyesters or other synthetic materials may also be used for the flexible washing material. An open weave nylon cloth is preferable because of its durability, smoothness, sufficient abrasiveness to cleanse and ability to dry within about 10 to 20 minutes.

The handle means 26 is an endless-shaped ring made from polymeric material. In one embodiment, the ring may be made from a polymeric rigid material. However, in a preferred embodiment, it is recommended that a flexible ring be utilized to relieve any strain on those with severe hand related handicaps. One practical application of making the handle means 26 is to use vinyl polyethelene tubing, typically about ½ inch outside diameter, wherein the tube ends are joined to form the ring at 32 and joined with securing means 28 such as a dowel pin with adhesive, cement, epoxy or plastic welded. Of course, the ends of the tubing may also be adapted such that the ends are releasably secured during use and can therefore be removed should one desire to remove the rings to place the wash cloth in a dryer.

Figure 3:
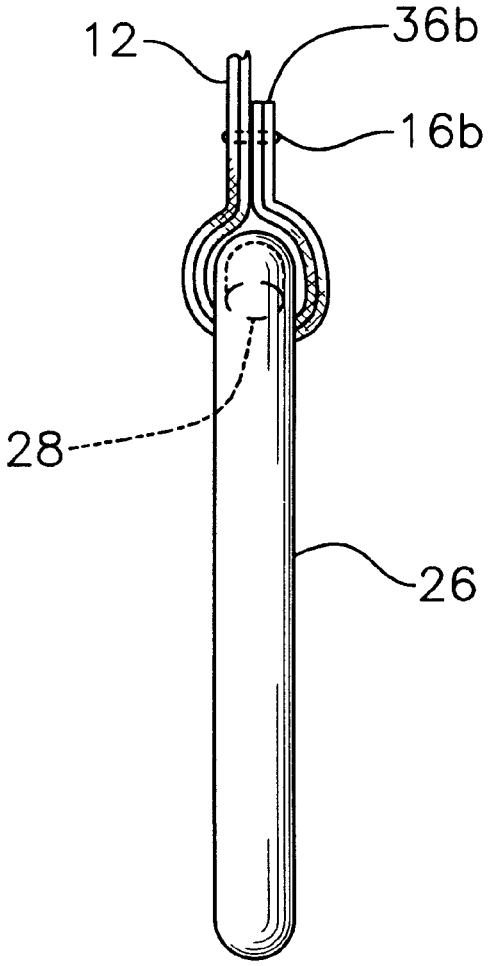
FIG. 3 is a side view of one of the end portions of the present invention.

Referring to FIGS. 1–3, the handle means 26 is slidingly engaged in a loop formed at each opposing end 36*a*,36*b* of the elongate sheet 12 of flexible material formed into the sleeve. Each end 36*a*,36*b* is wrapped around a portion of the handle means 26 and secured onto itself at stitch lines 16*a*,16*b* to form the loop. The sliding feature of the handle means 26 within the loop formed relieves the strain on the hands and shoulders of those with severe handicaps, thereby allowing the person to maintain a desired back washing direction. A fixed ring would change the direction of the wash cloth due to the person reacting to strains felt in the hands or shoulders.

As seen from the foregoing description, the present invention satisfies a long felt need to provide a device which is easy to use, especially for those with disabilities related to the hands, shoulders and arms.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for use in washing the back of a person consisting of:

an elongate sheet of a flexible nylon wash cloth having a first lateral end, a second lateral end, a first longitudinal edge and a second longitudinal edge, the sheet being folded such that the first and second longitudinal edges are secured together to form a sleeve;

means for holding cleaning means at an intermediate portion of the sleeve, the means for holding cleaning means being a pocket formed by securing opposing internal faces of the sleeve along predetermined stitch lines forming a perimeter of the pocket, the pocket further having an opening for inserting the cleaning means into the pocket and for removing the cleaning means therefrom;

the opening in the pocket further including means for releasably securing the cleaning means within the pocket;

handle means at each of the first and second ends of the elongate sheet forming the sleeve, each handle means being slidingly engaged with each of the ends; and each handle means being an endless-shaped ring for easy grasping by a person's hands, wherein when the cleaning means is secured into the pocket of the device, a back of the person is capable of being washed, wherein the device for use in washing the back of the person is capable of providing a wash while minimizing strain to the person's hands, arms and shoulders.

2. The device according to claim 1 wherein the stitch lines forming the perimeter of the pocket comprises:

at least one longitudinal stitch line parallel to the first and second longitudinal edges; and substantially parallel lateral stitch lines spaced apart a predetermined distance so that the formed pocket can receive the cleaning means.

3. The device according to claim 1 wherein the means for releasably securing the cleaning means within the pocket is selected from the group consisting of hook and loop fasteners.

4. The device according to claim 1 wherein each handle means is an endless-shaped rigid ring made from polymeric material.

5. The device according to claim 1 wherein each handle means is an endless-shaped flexible ring made from polymeric material.

6. The device according to claim 5 wherein each handle means is an endless-shaped flexible ring made from vinyl tubing, wherein the ends of the tubing are joined and secured to form the ring.

7. The device according to claim 1 wherein the handle means is slidingly engaged in a loop formed at each of the first and second ends of the elongate sheet of flexible material formed into the sleeve, each end being wrapped around a portion of the handle means and secured onto itself to form a loop.

8. A device for use in washing the back of a person consisting of:

an elongate sheet of a flexible nylon wash cloth having a first lateral end, a second lateral end, a first longitudinal edge and a second longitudinal edge, the sheet being folded such that the first and second longitudinal edges are secured together to form a sleeve;

means for holding cleaning means at an intermediate portion of the sleeve, the means for holding cleaning means being a pocket formed by securing opposing internal faces of the sleeve along predetermined stitch lines forming a perimeter of the pocket, the pocket further having an opening for inserting the cleaning means into the pocket and for removing the cleaning means therefrom;

the stitch lines forming the perimeter of the pocket including at least one longitudinal stitch line parallel to the first and second longitudinal edges and further including substantially parallel lateral stitch lines spaced apart a predetermined distance so that the formed pocket can receive the cleaning means;

the opening in the pocket further including hook and loop fasteners for releasably securing the cleaning means within the pocket;

handle means at each of the first and second ends of the elongate sheet forming the sleeve, each handle means being slidingly engaged with each of the ends; and each handle means being an endless-shaped ring for easy grasping by a person's hands, wherein when the cleaning means is secured into the pocket of the device, a back of the person is capable of being washed, wherein the device for use in washing the back of the person is capable of providing a wash while minimizing strain to the person's hands, arms and shoulders.

9. The device according to claim 8 wherein each handle means is an endless-shaped rigid ring made from polymeric material.

10. The device according to claim 8 wherein each handle means is an endless-shaped flexible ring made from polymeric material.

11. The device according to claim 10 wherein each handle means is an endless-shaped flexible ring made from vinyl tubing, wherein the ends of the tubing are joined and secured to form the ring.

12. The device according to claim 8 wherein the handle means is slidingly engaged in a loop formed at each of the first and second ends of the elongate sheet of flexible material formed into the sleeve, each end being wrapped around a portion of the handle means and secured onto itself to form the loop.

13. A device for use in washing the back of a person consisting of:

an elongate sheet of a flexible nylon wash cloth material having a first lateral end, a second lateral end, a first longitudinal edge and a second longitudinal edge, the sheet being folded such that the first and second longitudinal edges are secured together to form a sleeve;

means for holding cleaning means at an intermediate portion of the sleeve, the means for holding cleaning means being a pocket formed by securing opposing internal faces of the sleeve along predetermined stitch lines forming a perimeter of the pocket, the pocket further having an opening for inserting the cleaning means into the pocket and for removing the cleaning means therefrom;

the stitch lines forming the perimeter of the pocket including at least one longitudinal stitch line parallel to the first and second longitudinal edges and further including substantially parallel lateral stitch lines spaced apart a predetermined distance so that the formed pocket can receive the cleaning means;

the opening in the pocket further including hook and loop fasteners for releasably securing the cleaning means within the pocket;

handle means at each of the first and second ends of the elongate sheet forming the sleeve, each handle means being slidingly engaged with each of the ends; and each handle means being an endless-shaped flexible ring for easy grasping by a person's hands, the ring being made from vinyl tubing, wherein the ends of the tubing are joined and secured to form the ring, wherein when the cleaning means is secured into the pocket of the device, a back of the person is capable of being washed, wherein the device for use in washing the back of the person is capable of providing a wash while minimizing strain to the person's hands, arms and shoulders.

14. The device according to claim 13 wherein the handle means is slidingly engaged in a loop formed at each first and second end of the elongate sheet of flexible material formed into the sleeve, each first and second end being wrapped around a portion of the handle means and secured onto itself to form a loop.

* * * * *